US005433645A

United States Patent [19]

Henning, Sr.

[11] Patent Number: 5,433,645

[45] Date of Patent: Jul. 18, 1995

[54] REMOTE CONTROLLED MODEL TRAILER

[75] Inventor: Thomas C. Henning, Sr., Lansdale, Pa.

[73] Assignee: Daniel J. O'Neill, Souderton, Pa.

[21] Appl. No.: 237,666

[22] Filed: May 4, 1994

[51] Int. Cl.[6] ..... A63H 17/05

[52] U.S. Cl. ..... 446/427; 446/434; 446/489

[58] Field of Search ..... 446/427, 434, 456, 489, 446/475

[56] References Cited

U.S. PATENT DOCUMENTS 3,214,864 11/1965 Herman ..... 446/427 X
3,421,252 1/1969 Downey ..... 446/427
3,579,899 5/1971 Hannah ..... 446/427 X

*Primary Examiner*—Mickey Yu
*Attorney, Agent, or Firm*—John W. Logan, Jr. & Associates

[57] ABSTRACT

A model trailer is provided of the type for hauling trash from a collection point to a disposal site. The trailer has a frame, a hitch at one end of the frame and wheels at the other end. The trailer also has a trailer body including a base, a front wall, opposite side walls and a side-hinged rear gate. Within the trailer body is a remote radio controlled pusher blade which can be moved longitudinally of the trailer body to discharge contents of the trailer.

11 Claims, 2 Drawing Sheets

REMOTE CONTROLLED MODEL TRAILER

BACKGROUND OF THE INVENTION

1. Field of the Invention

The present invention relates to remote controlled model trailers of the type for hauling trash from a collection area to a disposal area. Conventional trailers of this type are adapted to be towed by a tractor and comprise an open top trailer with side walls, a hinged rear gate and a tarpaulin to cover the top of the trailer during transport. These trailers also include an ejector blade to push the trash contained within the trailer onto the disposal area when the trailer has reached its destination.

The remote controlled model trailer of the present invention simulates the operation of the conventional trash hauling trailer with a radio controlled push blade which is operated in a novel manner.

2. Description of the Prior Art

Conventional trash trailers of the type disclosed herein include an open top trailer, covered with a tarpaulin and an ejector blade to push the trash out of the trailer. The ejector blade is normally operated by a hydraulic cylinder or a feed screw and serves to positively force the trash out of the trailer. The present invention provides a model trash trailer which performs the same functions as existing trash trailers in a novel manner.

BRIEF DESCRIPTION OF THE PRESENT INVENTION

According to the present invention, a model trailer is provided including a bottom wall, a vertically hinged rear gate, side walls, a tarpaulin to cover the top of the trailer and novel means to-discharge trash from the model trailer. The discharge means includes a blade movable along guides in the trailer and propelled by a series of telescoping cylinders actuated by a motor driven coil spring member. The coil spring is contained within a tube in the trailer and moved forwardly or rearwardly by means of a pin disposed diametrically of the coil spring. A remote radio controlled motor is provided to move the spring and the pusher blade forward or backward. The coil spring in turn is attached to the forward member of the telescoping cylinders which in turn is secured to the pusher blade. As the coil spring is moved forward or backward relative to the length of the trailer, the pusher blade is advanced or retracted.

DETAILED DESCRIPTION OF THE INVENTION

Figure 1:
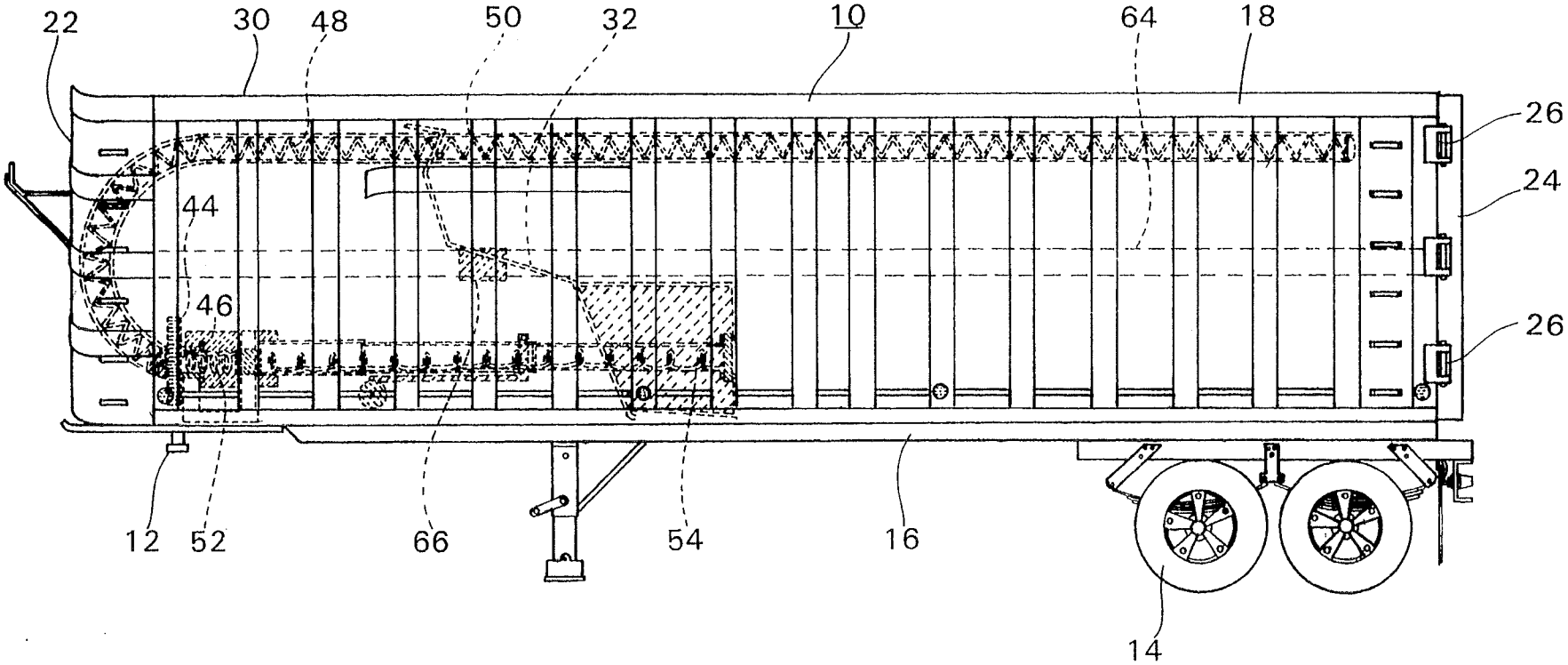
FIG. 1 is a side elevational view of a model trailer made in accordance with the present invention.
Figure 2:
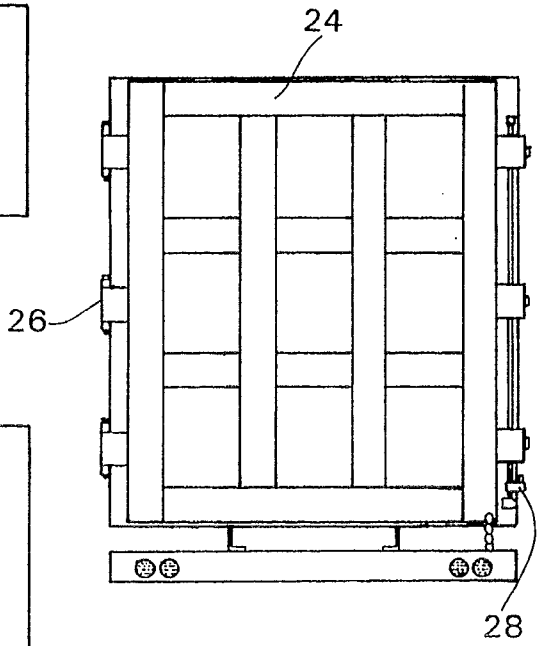
FIG. 2 is a rear view of the trailer of the present invention.

Referring more specifically to the drawings, as shown in FIG. 1, there is a model trailer 10 having a forward hitch 12 adapted to be connected to the conventional fifth wheel of a tractor, not shown, and a set of rear wheels 14. The trailer. 10 has a frame 16 and a body 18 having side walls 20, 20, a front wall 22 and a rear gate 24 hinged at one side as at 26 with conventional locking mechanism 28 at the other side of the gate. The upper end of the trailer 30 is open and is adapted to be covered by a tarpaulin, not shown.

Within the trailer body 18 is a pusher blade 32 which can be moved by a remote controlled drive mechanism 34 longitudinally of the trailer to push the contents thereof out of the open rear gate and then be retracted to receive an additional load of trash. The drive mechanism includes a support bracket 36 mounted on the floor 38 of the trailer which carries the drive mechanism of the present invention that actuates the pusher blade 32. The drive mechanism 34 includes a remote controlled electric motor 40 having a pinion 42 which engages and rotates a gear 44 mounted to rotate about the longitudinal axis of the trailer. The gear 44 has a hollow sleeve 46 formed coaxially therewith which rotatably mounts the gear on the support bracket 36. The driving means for the pusher blade further includes an elongated coil spring 48 contained within a sleeve 50 which terminates adjacent the drive gear 44 coaxially therewith and extends rearwardly therefrom and then curves around and extends to the rear of the trailer along one of the side walls thereof. In the illustrated embodiment of the present invention, the sleeve 50 is secured to the side wall of the trailer adjacent its upper edge. However, in a preferred embodiment, the sleeve 50 could be placed adjacent the base of the trailer beneath a false floor, not shown.

Within the sleeve of the gear, is a diametrical pin 52 which passes between adjacent coils of the spring 48 and, depending on the direction of rotation of the gear, will move the end of the spring toward or away from the rear end of the trailer.

In the preferred embodiment of the present invention, the forward end 54 of the coil spring passes through a series of telescoping sleeves 56 which support the coil spring and is attached to the rear of the pusher blade 32. As the motor is rotated in one direction, the forward end 54 of the coil spring is driven toward the rear of the model trailer moving the pusher blade toward the gate, which has previously been opened, to force trash in the trailer out of the trailer. After the trash is discharged, the direction of rotation of the motor is reversed and the pusher blade is retracted to its original position. As shown in the drawings, there are a plurality of telescoping sleeves 56, with the sleeves supported by a bracket 58 having wheels 60 which ride on the floor of the trailer.

Figure 3:
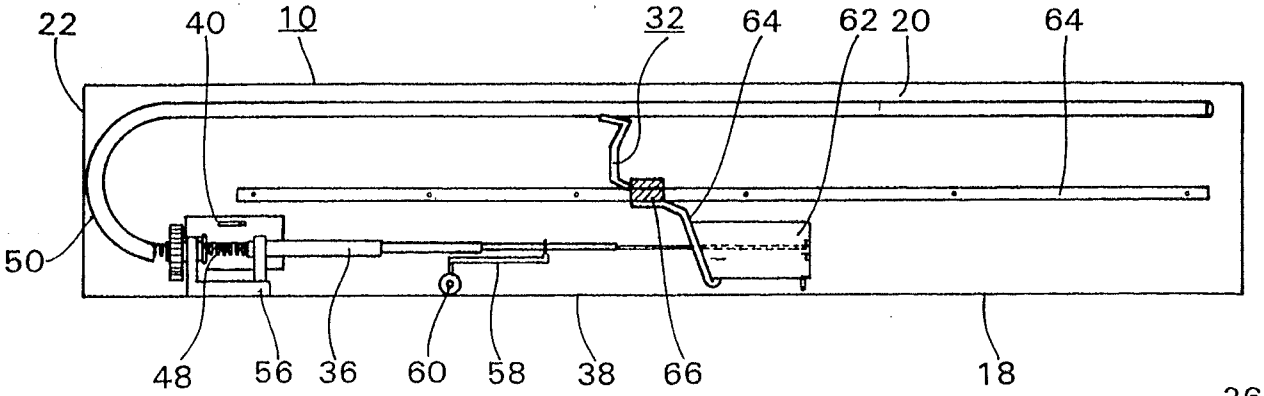
FIG. 3 is a longitudinal sectional view of the trailer of the present invention showing the means for actuating the pusher blade.
Figure 4:
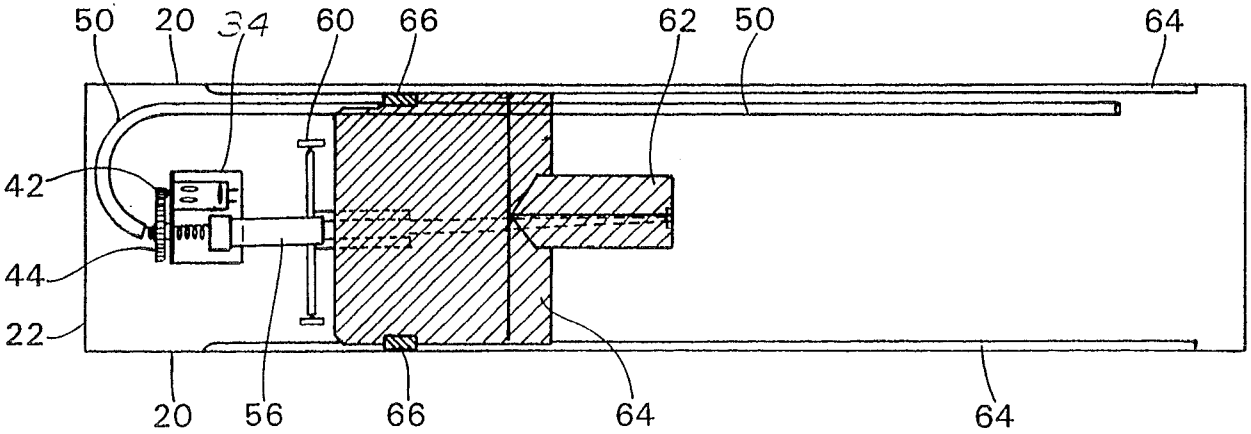
FIG. 4 is a plan view of the trailer of the present invention.

The pusher blade 32, as shown in FIGS. 3 and 4, includes a nose portion 62 and a blade member 64 extending widthwise of the trailer. The blade angles upwardly toward the forward end of the trailer from the base, as shown in FIG. 3 and terminates in a vertical and then slightly forwardly extending portion to engage material in the trailer and discharge the same from the trailer. Guide rails 66, 66 mounted on the side walls of the trailer engage slide blocks 68, 68 carried by opposite sides of the pusher blade 32 to guide movement of the pusher blade 32.

The tractor for the trailer of the present invention is a conventional radio controlled tractor with servo motors to drive and steer the tractor. Also, a conventional controller, not shown, such as a remote radio control unit Model D-14, sold by the Johaness Graupner Company of Kirckheim-Tech, Germany, will be provided to control operation of the tractor and trailer servo motors.

While a particular embodiment of the present invention has been illustrated and described herein, it is not intended to limit the invention to such a disclosure and changes and modifications may be incorporated therein within the scope of the following claims.

I claim:

1. A model trailer adapted to be pulled by a radio controlled tractor, said trailer having a frame, a body mounted on said frame and extending lengthwise thereof, a hitch at the forward end of the frame and wheels at the rear end thereof;

said body having a continuous flat base, a front wall, first and second opposite side walls and a rear gate, the rear gate mounted at one side edge thereof to the first side wall of the body by a hinge, and locking means on said gate to engage and lock the gate to the second side wall;

a pusher blade extending upwardly from the base of the trailer between the opposite side walls thereof;

mounting means for the pusher blade on said opposite side walls supporting the pusher blade for sliding movement from the front wall of the trailer body to the rear gate and return;

a servo motor intermediate the pusher blade and the front wall of the trailer to cause movement of the pusher blade;

a servo motor support block mounting said servo motor on said trailer; and drive means interconnecting the servo motor and the pusher blade to drive the pusher blade toward and away from the rear gate;

said drive means including a telescoping tube having a first end connected to said servo motor support block and a second end connected to the pusher blade, said telescoping tube being extendable and contractible between elongated and contracted positions lengthwise of the frame, and means within said telescoping tube driven by said servo motor to cause said telescoping tube to elongate and contract.

2. A model trailer in accordance with claim 1 wherein the mounting means for said pusher blade includes a horizontal guide extending lengthwise of each side wall and guide blocks carried by opposite side edges of said pusher blade engaged within said horizontal guides.

3. A model trailer in accordance with claim 1 wherein the means to cause movement of the telescoping tube includes a flexible member extending through the telescoping tube and interconnected with the second end thereof and the pusher blade, said flexible member adapted to be driven lengthwise of said telescoping tube by said servo motor.

4. A model trailer in accordance with claim 3 wherein said flexible member is a helical spring of uniform diameter.

5. A model trailer in accordance with claim 4 including a drive gear, a pinion on said servo motor in engagement with said drive gear to rotate the same, and means interconnecting the drive gear and helical spring to impart longitudinal movement to the spring upon rotation of the drive gear.

6. A model trailer in accordance with claim 5 wherein a hollow sleeve is secured to said drive gear coaxially therewith, said hollow sleeve being mounted for rotational movement in said support block, said helical spring passing coaxially through said hollow sleeve, and a drive pin extending diametrically of said hollow sleeve in engagement with said helical spring to move said spring longitudinally upon rotation of said sleeve.

7. A model trailer in accordance with claim 6 including an elongated tube terminating adjacent the drive gear and containing said helical spring.

8. A model trailer in accordance with claim 7 wherein said elongated tube extends along a curved path from said drive gear to one of said side walls and then runs in a straight path along said side wall.

9. A model trailer in accordance with claim 3 wherein said telescoping tube includes multiple telescoping sections including a first section connected to said servo motor support block, a second section connected to said pusher blade and at least one intermediate section.

10. A model trailer in accordance with claim 9 including support means for said telescoping tube to support the same above the base of the trailer body.

11. A model trailer in accordance with claim 10 wherein the support means for said telescoping tube includes a bracket connected to said intermediate tube section and wheels on said bracket riding on the base of the trailer body.

* * * * *